US006679649B1

(12) United States Patent
Capolupo

(10) Patent No.: US 6,679,649 B1
(45) Date of Patent: Jan. 20, 2004

(54) BARRIER WALL APPARATUS AND METHOD OF CONSTRUCTION

(75) Inventor: Wayne P. Capolupo, Salisbury, MA (US)

(73) Assignee: SPS New England, Inc., Salisbury, MA (US)

( * ) Notice: Subject to any disclaimer, the term of this patent is extended or adjusted under 35 U.S.C. 154(b) by 0 days.

(21) Appl. No.: 10/330,809

(22) Filed: Dec. 27, 2002

(51) Int. Cl.[7] ..... E01F 13/00
(52) U.S. Cl. ..... 404/6; 52/295; 256/13.1
(58) Field of Search ..... 404/6, 7, 9, 10; 256/1, 13.1; 52/294, 295, 296, 297; 249/97

(56) References Cited

U.S. PATENT DOCUMENTS

| | | | | |
|---|---|---|---|---|
| 4,494,892 A | | 1/1985 | Wojciechowski | |
| 4,496,264 A | | 1/1985 | Casey | |
| 4,605,336 A | * | 8/1986 | Slaw, Sr. | 404/6 |
| 4,954,009 A | * | 9/1990 | Kellison | 404/6 |
| 4,964,750 A | | 10/1990 | House et al. | |
| 5,131,786 A | | 7/1992 | House et al. | |
| 5,218,805 A | * | 6/1993 | Rex | 52/295 |
| 5,286,136 A | | 2/1994 | Mandish et al. | |
| 5,292,467 A | | 3/1994 | Mandish | |
| 5,533,888 A | | 7/1996 | Belarde | |
| 5,611,182 A | | 3/1997 | Spude | |
| 5,651,635 A | | 7/1997 | Nagle | |
| 5,685,665 A | | 11/1997 | Lembo | |
| 5,697,728 A | | 12/1997 | Camomilla et al. | |
| 5,882,140 A | | 3/1999 | Yodock | |
| 5,988,934 A | | 11/1999 | Wasserstrom | |
| 6,164,865 A | | 12/2000 | McCallum | |
| 6,176,638 B1 | | 1/2001 | Kellison et al. | |
| 6,394,410 B1 | * | 5/2002 | Thompson | 249/97 |

FOREIGN PATENT DOCUMENTS

| | | | | |
|---|---|---|---|---|
| DE | 3301539 A | * | 9/1983 | E01F/13/00 |
| JP | 09291516 A | * | 11/1997 | E01F/15/00 |

* cited by examiner

*Primary Examiner*—Robert E. Pezzuto
*Assistant Examiner*—Alexandra K. Pechhold
(74) *Attorney, Agent, or Firm*—Law Offices of Michael Leccese, P.C.; Michael Leccese, Esq.

(57) ABSTRACT

An apparatus and method of constructing barrier wall structures. More particularly, the invention relates to a manner in which to use common building materials and methods in erecting a barrier wall system more efficiently than in the past. The apparatus includes among its essential elements a formed reinforcement cage; a plurality of spacers that are used to support the reinforcement cage; a plurality of cable anchors each being an elongated member having a first end and a second end, wherein the first end is anchored to the ground and the second end is adapted to be attached to a cable; a plurality of elongated cable members that connects the reinforcement cage and the anchor member; a plurality of cable gripping members for holding the cables taut wherein the cables secures in place the reinforcement cage; and, a formed outer concrete layer that is molded over the reinforcement cage.

11 Claims, 4 Drawing Sheets

BARRIER WALL APPARATUS AND METHOD OF CONSTRUCTION

FIELD

The invention relates generally to a slip formed barrier wall structure and method of construction, more particularly an improved barrier system and method that results in secure placement and retaining of reinforcement cage within barrier wall allowing for slip form process to take place without the need for a poured anchoring base footing or slab base.

BACKGROUND

In the past, continuously forming a concrete structure at grade level running generally horizontal was anchored by concrete footing structures incorporating anchoring points. Typical construction consists of first constructing concrete footings incorporating anchoring points, after the footings are complete the desired shaped concrete structure is then formed atop the footing using the anchoring points within the footings to secure the structure. Anchoring points typically are comprised of short elongated reinforcement bar with one end embedded into the footing and the other end extending upward from the concrete. The structure is connected to these anchoring points to prevent unwanted movement of the system. One process used to form this shaped structure that sits atop the footing is a process of continuously forming concrete structures generally known in the arts as slip forming, as disclosed in U.S. Pat. No. 5,533,888. Among other items the process encompasses a machine that includes a frame and a form. The frame holds a form that encloses an area having a cross sectional configuration corresponding to the predetermined cross sectional configuration of the concrete structure desired. The form is moved along at grade as the forward end of the form is being supplied with un-cured concrete. As the form moves it extrudes and shapes the concrete using processes that include preset vibrations and continuous forces. The un-cured concrete semi sets within the form as the form moves along at grade, the concrete is shaped in place and is free standing as it emerges out from the second end of the form creating a formed self supporting concrete barrier wall. It is also well known in the arts that concrete barrier walls constructed solely of concrete may not result in desired strengths of the wall. Commonly, the concrete wall structure is supplemented with reinforcing bar (rebar), when the concrete is formed and cured around the reinforcing bar the resultant structure has a more stable desirable structure and one that has good strength. One way currently used to strengthen a barrier wall is to position reinforcing members within the concrete wall during the slip form process. Today, one way this is accomplish is by simply pushing reinforcement rods into the un-cured concrete at the forward end of slip form equipment as it moves along the grade therefor resulting in embedded bars within the concrete. However, this process ends in inconstant wall strength and may even result in undesired wall strength. It is also well known in the arts to use the slip form process to form barrier walls that include a preformed reinforcement cage. First, the reinforcement cage is built, next the cage is secured in place which prevents movement of the cage as the slip form moves over the anchored reinforcement cage. Anchoring the cage is necessary to the slip form process, anchoring of the cage prevents movement of the cage during the slip form process. A well-anchored cage stays in place and results in creating a strong sturdy barrier wall. In many locations, specifications require the concrete construction to contain reinforcement bar structures molded within the concrete to assure desired structure strength. The reinforcement cage can be made up of a plurality of preformed reinforcement bars that are held together by several wire tie wraps, or the cage can be welded together, or any other similar method of fixing the members of the reinforcement bar in place to form the cage. If the cage is not anchored in place during the slip form process then the final slip formed structure will not net desired results. During the slip form process the slip form machine with it's mold structure moves along grade guided over the cage. As the mold moves concrete is added to create the wall shape, this practice exerts numerous loads and forces on the cage, for instance, pushing pulling and twisting. These loads applied to the cage will result in movement of the cage causing the cage to move out of it original location. Movement of the cage will place the cage in an unknown location within the mold. Unknown placement of the cage within the mold is considered unacceptable because it creates an unwanted inconsistently strong barrier wall. In some cases the reinforcement cage will not be totally embedded within the concrete therefore causing the reinforcement bar to be exposed to the elements when the concrete cures. The exposed reinforcement cage will then rust and degrade the structure at rapid rate. These varying loads are exerted on the reinforcement cage as a result of the slip forming process and the concrete that is supplied to the slip form equipment and the loads on the cage as the slip form mold is moved over the grade. Typically, to hold a reinforcement cage in place, a formed footing is constructed containing anchoring points such that the reinforcement cage can sit on the footing and be anchored securely to the anchoring points to prevent movement of the cage during slip forming.

Many slip formed barrier wall systems today use poured concrete footings that include anchor points to anchor the reinforcement bar cage during the slip forming process. The slip formed barrier wall sits on this footing and the reinforcement cage is anchored to the anchor ties on this footing. Footings are typically poured concrete structures that run substantially along the ground at grade. A footing typically includes a plurality of substantially vertically positioned anchoring bars that are placed in several locations within the concrete prior to curing. After the concrete footing cures the anchoring bars are fixed in place, embedded in the footing and then used as anchor points to tie the reinforcement cage prior to the slip forming process. The cage can be secured to the anchoring bars poured into the footing by tying the cage to the anchor bars, or the cage can be welded directly to the anchor bars or any other common way of attachment. The reinforcement cage can either be placed directly on the footing or can be placed on spacers that are in communication with both the footing and the reinforcement cage. Once the reinforcement cage is secured to the anchor bars the slip form apparatus and form is positioned over the reinforcement cage. The form moves along the grade as it is being supplied with concrete resulting in a barrier wall, effectively extruding a barrier wall that contains an embedded reinforcement cage.

This traditional way of construction has been found by the inventor to be time consuming, costly and not required. The traditional way of construction is burdensome and unnecessary to accomplish the result of the anchored barrier wall. Consequently, many contractors have attempted various alternative ways to anchor such walls including; securing wall structures to anchors embedded in concrete slabs; drilling holes in the cured footing and or concrete slabs and pouring in quantities of a hardening liquid securing agent creating an anchoring effect; forming a footer along the length of the proposed barrier wall that includes anchoring points and positioning the reinforcement bar or reinforcement cage on the footer. The inventor has a novel solution to overcome the problems of past barrier wall construction.

Further drawbacks in the design of such prior art will be manifested by the uneven quality of work done. For instance, in order for the wall system to work correctly, the quality of the footing must be the same or compatible to that of the wall. For example, the footings and footing anchors must be poured and allowed to set prior to the forming of the barrier wall. If the footing is not allowed to cure correctly the concrete will not possess it's anticipated strength. If the concrete is not strong it typically will result in poor anchoring points for the constructed wall. The result of these poor anchoring points could degrade the system by not providing the means to anchor securely and when the wall is slip formed the cage shifts. Also if not properly anchored due to a poor footing process, the cage will not be placed at the desired location within the wall making the strength of the wall inconsistent. Moreover, displacement of the cage may even allow the reinforcement bar to reveal itself through the concrete and rust over time.

SUMMARY

This invention provides an apparatus and method of constructing barrier wall structures. More particularly, embodiment of the invention relates to a manner in which to use common building materials and methods in erecting a barrier wall system more efficiently and effectively than in the past. Using embodiments and implementations of this invention will allow the user to construct a barrier wall having the same if not better properties as previous methods. Moreover, embodiments and implementations of this invention will allow the user to construct the barrier wall more efficiently and effectively, resulting in time and energy savings, without sacrificing strength, function or appearance. This invention is directed toward construction of barrier wall systems using a process known as slip forming where a concrete barrier can be formed by a machine that extrudes un-cured concrete into a formed shape as the machine moves along the ground. The shape can be of any cross sectional configuration including shaped walls of varying styles. Slip forming involves the delivery of stiff un-cured concrete in a hopper of a machine that then forces the concrete through a mold for forming the concrete to a desired shape. One advantage of this process is that the machine travels along the ground as it is extruding the concrete, thereby allowing the process to be continuous and well suited for constructing shapes that run along the ground for an indefinite length.

Furthermore this invention will supply the necessary apparatus and method to eliminate the need for a pre process step in forming a slip formed barrier wall. Implementations of the invention eliminate the need of the pre process step in the current process of laying a footing or base slab that contains anchoring points to anchor the reinforcement cage prior to slip forming. Implementations use ground anchors at various locations along the length of the wall to anchor the preformed reinforced cage. These ground anchors, when used in communication with a length of cable and cable fasteners, allow the user to secure the reinforcement cage prior to slip forming without the need for a footing or base. The elimination of the footing or base slab is advantageous over previous apparatus and methods in that it is quickly adaptable using common construction practices and is more efficient to build.

Implementations further provide an apparatus and method of construction to reduce the amount of construction material used to form concrete barriers, thereby making this more efficient than previous methods. Wherein the current method of construction more concrete materiel is needed to form footings for anchoring points this invention eliminates the need for this poured footings thereby reducing the amount concrete needed to form the final product. Moreover, it is also economical in the that forming the barrier takes less time and reduces the amount of time the machines are required to operate and therefor reduces the amount of man, and machine power taken to construct, thereby using less energy.

It is a further object of this invention to provide an apparatus and method that is simple by design and efficient in method and use.

In one embodiment, a barrier wall that can be formed for use as a roadside barrier wall is commonly known within the arts as a Jersey barrier (roadside traffic barrier). Such an embodiment includes a plurality of formed reinforcement cage sections constructed and arranged to be substantially perpendicular to the ground. These cage sections are being placed apart from one another in accordance with a predetermined spacing substantially perpendicular to the ground. These cage sections are connected together with a plurality of reinforcing bars that run substantially parallel to the ground and are fixedly attached to the formed reinforcement cage sections. This, in turn forms a wire cage assembly or reinforcement cage that runs substantially parallel to the ground at a predetermined length. This wire reinforcement cage rests on a number of spacers such that the cage is not in intimate contact with the ground. The spacers are set along the ground in accordance with a predetermined spacing. Cable anchors are also implemented being distributed along the ground in accordance with a predetermined spacing. In one embodiment, a ground or soil anchor includes a first end having a helical shape that can be screwed into the ground for establishing solid anchoring point. The second end of the cable anchor one such embodiment includes an eye loop adapted for receiving a cable to create the connection between the wire cage and the ground. The cable is in communication with the cable anchor and the cage that is kept taut by means of a cable fastener or cable gripping means that allows the cable to be kept under tension so that the wire cage is held against the spacer preventing movement of the cage. The combination of the spacer, anchor, cable and cable fasteners results in stabilization of the reinforcement cage prior to the slip forming concrete operation. The slip forming operation molds the concrete around the reinforcement cage, embedding the cage, spacers, anchors and cables all within the structure.

The process of forming this structure can be implemented by forming a reinforcement cage adapted to be substantially perpendicular to the ground extending longitudinally along the ground. This is done by positioning a spacer having a top side and a bottom side wherein the bottom side of the spacer is contacting the ground. The reinforcement cage is placed on the on the topside of the spacer supporting the reinforcement cage. The reinforcement cage not being in direct contact with the ground. Using a cable to secure the reinforcement cage by connecting a cable to the first end of an elongated cable anchor member that is fixedly attached to the ground and then, connecting the cable to the reinforcement cage. To hold the reinforcement cage in place the cable is pulled taut and held taut using the cable gripping fastening members. The taut cable is holding the reinforcement cage against the spacer, securing the reinforcement cage in place and preventing movement of the cage. The slip form machine is moved along at grade supplying concrete to it's mold forming a shaped concrete thickness over the reinforcement cage that is being securely held in place.

Illustrative embodiments and modes of operation of the present invention have been described in this specification. The invention which is intended to be protected herein, however, is not to be construed as limited to the particular embodiments disclosed, since these embodiments are to be regarded as illustrative rather than restrictive. Variations and changes may be made by others without departing from the spirit of this invention. Accordingly, it is expressly intended that all such variations and changes which fall within the spirit and scope of the claims be embraced thereby.

BRIEF DESCRIPTION OF DRAWINGS

Other objects, features, and advantages will occur to those skilled in the art from the following description of an embodiment and the accompanying drawings, in which.

DETAILED DESCRIPTION

Figure 1:
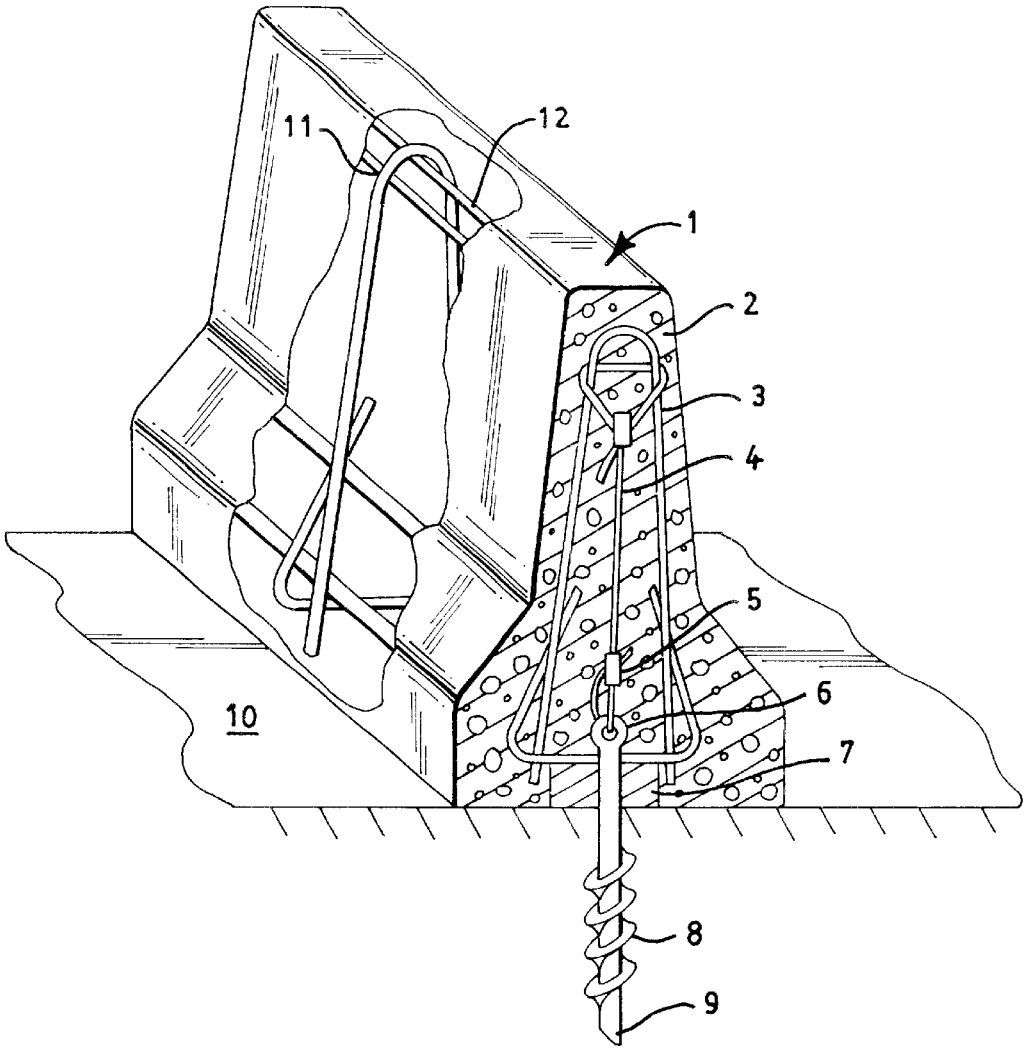
FIG. 1, shows a perspective view section drawing with a cut away detail, the perspective view shows an elongated barrier that runs substantially horizontal along the ground, the section taken through the barrier shows the ground anchor, connecting cable and a reinforcement cage section as it rests on the spacer, the cut away detail shows a reinforcement cage section along with substantially horizontal reinforcement bar that attach the reinforcement section creating the reinforcement cage.
Figure 2:
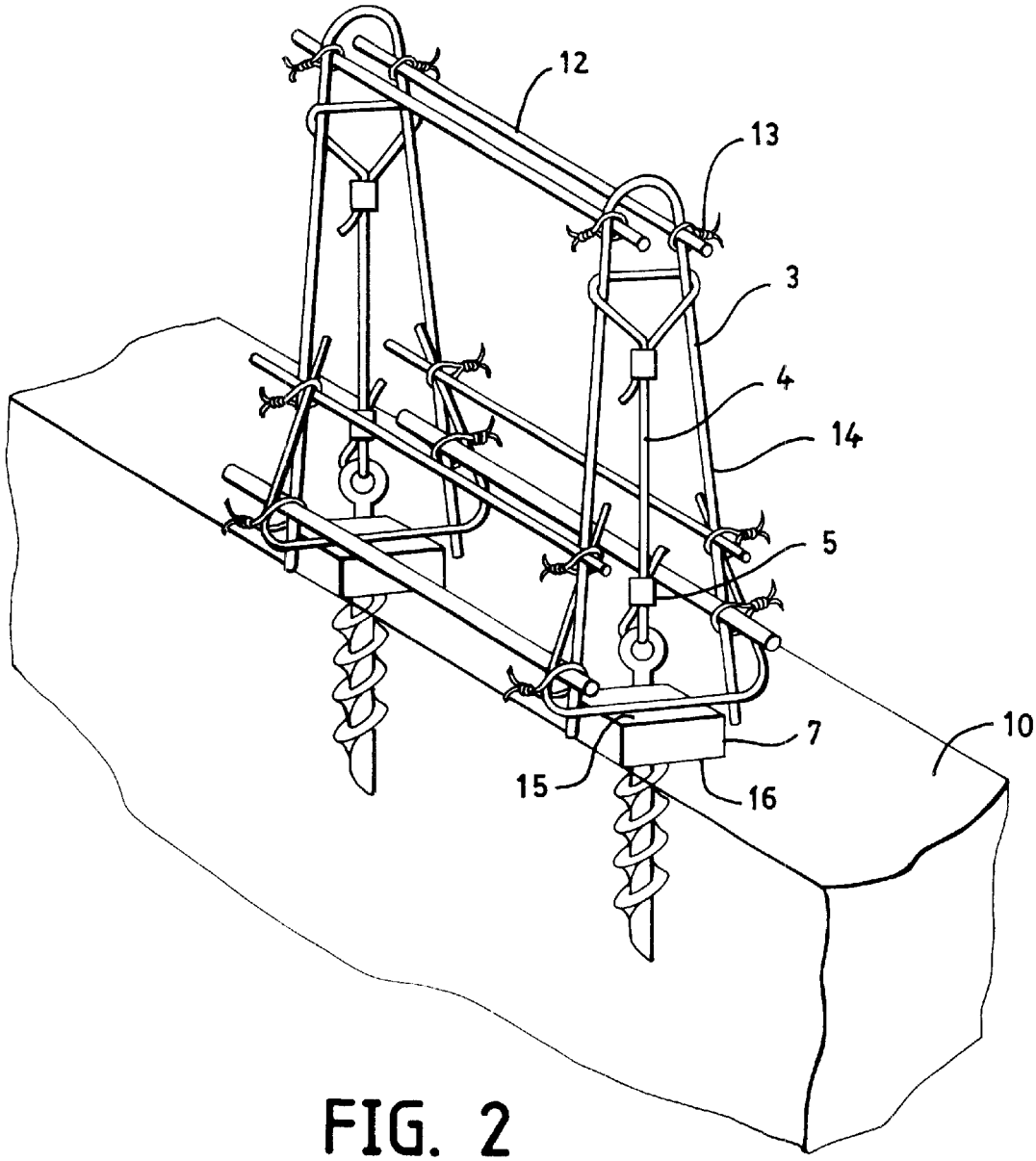
FIG. 2, shows a perspective view section which depicts the reinforcement cage sections connected together by substantially horizontal reinforcement bar that is joined together by reinforcement ties to form the reinforcement cage that all rests on spacers placed on the ground with the cage being anchored using a cable connected between the reinforcement cage and ground anchor, all is shown without being embedded within the concrete barrier.
Figure 3:
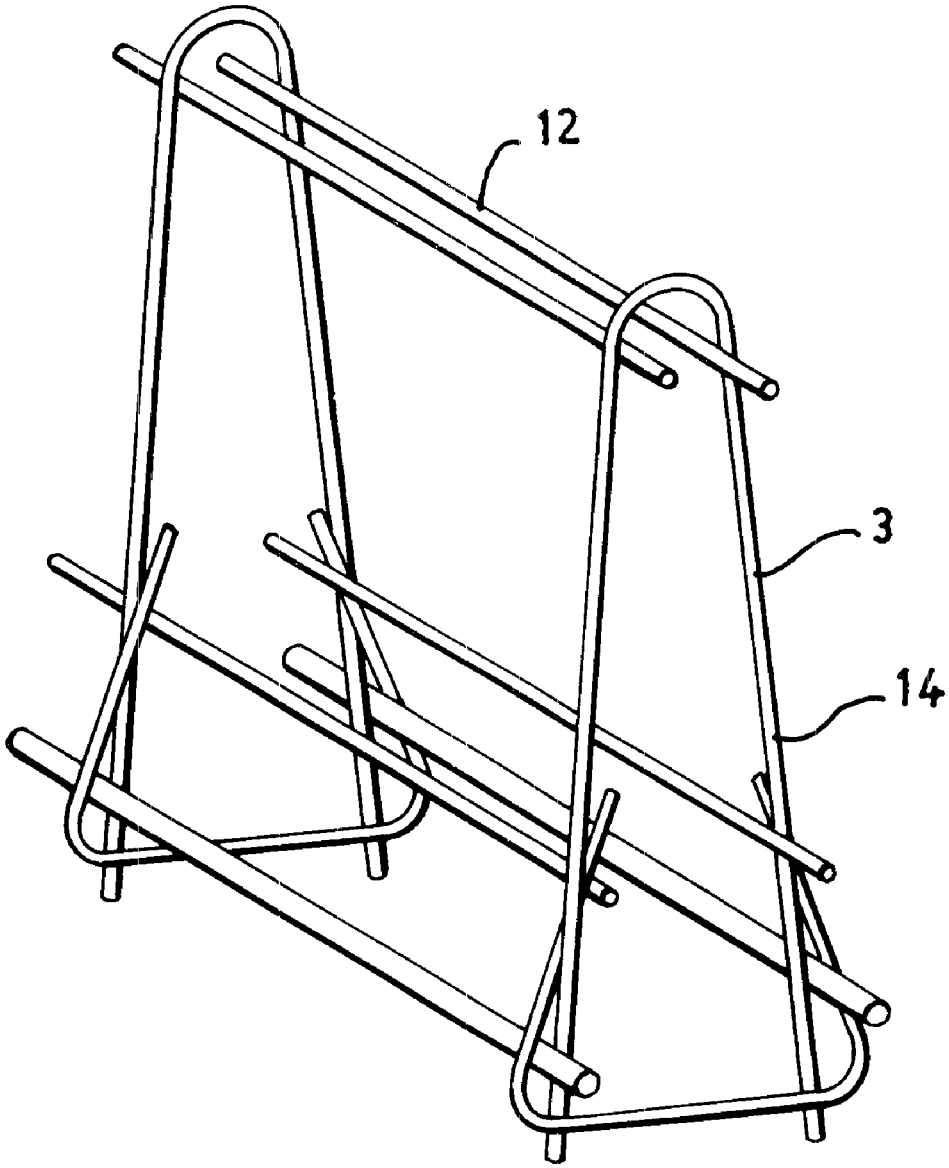
FIG. 3, shows a perspective view of the reinforcement cage including the reinforcement cage sections and connecting reinforcement bars that connect the reinforcement sections.
Figure 4:
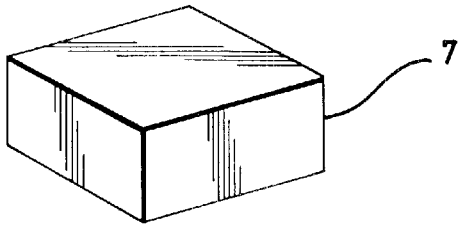
FIG. 4, shows a perspective view of a spacer.
Figure 5:
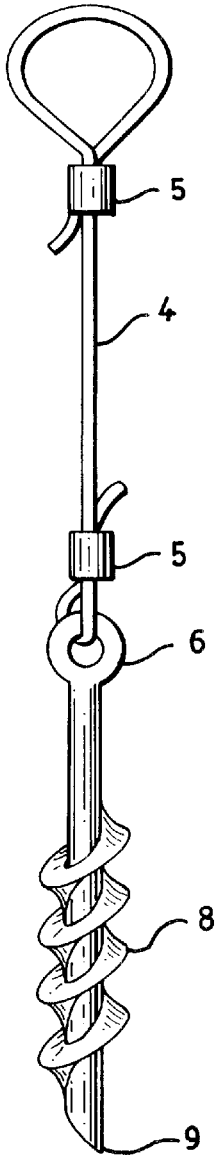
FIG. 5, depicts a side view of the cable and cable ties as it is connected to the ground anchor.

There is shown in FIGS. 1 through 5 an illustrated barrier wall 1. The barrier wall apparatus 1 comprises a plurality of formed reinforcement cage sections 3 constructed and arranged to be substantially perpendicular to the ground 10. The barrier wall also includes a plurality of substantially horizontal reinforcing bars 12 that are in communication with the formed reinforcement cage sections 3 creating a reinforcement cage 14 as show in FIG. 3. In one illustration the elongated reinforcing bars can be held together using ties 13 or weldments. The reinforcement cage 14 extends longitudinally along the ground 10 for a predetermined length. The reinforcement cage 14 sits on a plurality of spacers 7. Each spacer 7 has a top side 15, and a bottom side 16. When a spacer 7 is deployed the bottom side 16 of the spacer 7 is in contact with the ground 10 and the formed reinforcement cage 14 sits on the top side 15 of the spacer supporting the reinforcement cage 14. A plurality of cable anchors 8 positioned along the ground 10, each cable anchor being an elongated member having a first end 9 and a second end 6. Wherein the first end 9 of the cable anchor 8 is in communication with the ground 10 and the second end 6 in communication with the cable 4 that when pulled taut will secure the reinforcement cage 14. An elongated cable member 4 that connects the reinforcement bar cage 14 and the second end 6 of the cable anchor 8 is used and pulled taut being secured by the cable gripping member 5 wherein the cable 4 is held taut. In one embodiment, the second end 6 of the elongated cable anchor 8 is shaped to form an eye loop. A cable gripping member 5 for holding the cable 4 is used wherein the cable gripping member 5 holds the cable 4 taut, which in turn 4 secures in place the reinforcement bar cage 14 against the spacer 7. Finally, a formed outer concrete layer 2 is molded over the reinforcement cage 14 that is secured in place with the cable 4 and cable anchor 8 resulting in a reinforced barrier wall structure 1.

What is claimed is:

1. A wall barrier system comprising;

a plurality of formed reinforcement cage sections constructed and arranged to be substantially perpendicular to the ground, a plurality of elongated reinforcing bars that communicate with the formed reinforcement cage sections to create a reinforcement cage that extends longitudinally along the ground, a plurality of spacers placed at selected locations along the ground, each spacer having a top side and a bottom side, the bottom side of the spacer being in contact with the ground, and the top side of the spacer supporting the reinforcement cage, a plurality of cable anchors, each of the cable anchors being an elongated member having a first end and a second end, wherein the first end is anchored into the ground, a plurality of cable members, each of the cable members being an elongated member that connects the reinforcement bar cage and the second end of the cable anchor, a plurality of cable gripping members, each cable gripping member for holding the cable wherein the cable secures in place the reinforcement bar cage; and, a formed outer concrete layer that is molded over the reinforcement cage.

2. The wall barrier system of claim 1 wherein the reinforcement cage is constructed from rebar.

3. The wall barrier system of claim 1 wherein the cable anchors second end includes an eye loop.

4. The wall barrier system of claim 1 wherein the anchor member has a helical configuration such that the anchor member is screwed into the ground.

5. The wall barrier system of claim 1 wherein the anchor member is adapted for being anchored to rock.

6. The wall barrier system of claim 1 wherein the spacer is made from concrete.

7. The wall barrier system of claim 1 wherein the cable is a member made from twisted wire strands.

8. A method of forming a barrier wall comprising;

forming a reinforcement cage section constructed and arranged to be substantially perpendicular to the ground, placing a plurality of reinforcement cage sections at a predetermined spacing and attaching the reinforcement cage sections together using a plurality of substantially horizontal reinforcement bars wherein creating a reinforcement cage, positioning a plurality of spacers along the ground with each spacer having a top side and a bottom side wherein the bottom side of the spacer is contacting the ground, and placing the formed reinforcement cage on the top side of each spacer, where the spacer is supporting the reinforcement cage as the reinforcement cage runs substantially along the ground, connecting a plurality of elongated cables, each cable connecting to the first end of an elongated cable anchor member that is secured to the ground and then, connecting the cables second end to the reinforcement cage and, pulling the cable taut, clamping the cable using, a plurality of cable gripping members wherein each cable gripping member is used for holding the cable taut, the taut cable holding the reinforcement cage preventing movement of the reinforcement cage; and, forming an outer concrete layer that is shaped over the reinforcement cage that is being held in place with the cable and cable anchor embedding the reinforcement cage, cable, spacer and anchor within the concrete.

9. The method of forming a barrier wall of claim 8 wherein the reinforcement cage is formed using a plurality of formed elongated rod members or rebar.

10. The method of forming a barrier wall of claim 8 wherein the second end of the cable end is fixed to the ground by screwing the anchor into the ground.

11. The method of forming a barrier wall of claim 8 wherein the forming process is slip forming.

* * * * *